United States Patent [19]

King

[11] 4,140,256

[45] Feb. 20, 1979

[54] TOOL CADDY

[75] Inventor: Clarence J. King, Ludington, Mich.

[73] Assignee: Straits Steel & Wire Co., Ludington, Mich.

[21] Appl. No.: 773,003

[22] Filed: Feb. 28, 1977

[51] Int. Cl.[2] ..... A47G 23/00

[52] U.S. Cl. ..... 224/48 W; 206/373; 224/48 F

[58] Field of Search ..... 224/48 W, 48 D, 48 E, 224/48 R, 48 F; 206/372, 373; 211/60 T, 60 R, 106, 88

[56] References Cited

U.S. PATENT DOCUMENTS

| | | | |
|---|---|---|---|
| 759,025 | 5/1904 | Schiele | 211/106 |
| 994,984 | 6/1911 | Dennis | 224/48 W |
| 2,903,137 | 9/1959 | Brown | 211/106 X |
| 3,268,087 | 8/1966 | Kramer | 211/60 R X |
| 3,789,996 | 2/1974 | Stroh | 211/106 X |

*Primary Examiner*—Francis S. Husar
*Assistant Examiner*—Donald W. Underwood
*Attorney, Agent, or Firm*—Price, Heneveld, Huizenga & Cooper

[57] ABSTRACT

A tool caddy for the storage of hand tools, miscellaneous small articles and small parts includes an elongated horizontal front wire stretcher, a pair of wire side members each joined to an end of the front wire stretcher and extending downwardly therefrom. At least one storage bin is supported by the side members. A rectangular mesh including a plurality of longitudinal and tranverse strands is supported by the front wire stretcher and the side members. The rectangular mesh defines a plurality of openings dimensioned to support a wide variety of hand tools.

15 Claims, 5 Drawing Figures

TOOL CADDY

DETAILED DESCRIPTION OF THE PREFERRED EMBODIMENT

This invention relates to tool and small parts holders and more particularly to a unique, wire tool and parts caddy.

Heretofore various proposals have been made for the storage of hand tools, small parts and other miscellaneous articles in a workshop. Such proposals have taken the form of tool chests or storage bins having a plurality of drawers and/or removable bins within which the tools, small parts and miscellaneous articles are placed. Such shelves and drawers are typically contained in a cabinet or other such structure which is placed on a shelf or work surface. Also, various proposals have been made for storing or supporting hand tools from a vertical wall surface. One such arrangement employs a pegboard having a plurality of holes formed therein within which are disposed wire racks. These racks are designed to suspend hand tools such as pliers, screwdrivers miscellaneous wrenches, hammers and the like from the pegboard surface. Such prior art devices may not be employed interchangeably to support or store the tools either from a vertical wall surface or from a horizontal work surface.

The structures which employ drawers and shelves do not properly organize the tools for ease of access and selection. The tools and the miscellaneous parts and other small articles are generally not in the open for ready reach. Further, such drawers and shelves tend to collect dirt and oil. The prior wire structures mountable to a vertical surface do not generally provide storage for both hand tools and for small parts and other miscellaneous articles. Further, these devices are not adapted for placement on a horizontal surface such as a workbench or conventional shelving.

SUMMARY OF THE INVENTION

A need, therefore, exists for a simple, easily manufactured rack structure capable of storing conventional hand tools and miscellaneous small articles which is adapted for both wall mounting and for placement on a horizontal surface in the work area. In accordance with the present invention, a unique rack structure or tool caddy is provided which is easily manufactured, readily mountable on either a vertical surface or positionable on a horizontal surface, is aesthetically pleasing and which permits organization of hand tools, small parts and miscellaneous articles so that they will be readily visible and accessible for use and selection. Essentially, the unique tool caddy or rack structure includes an elongated, horizontal front wire stretcher, a pair of side members each joined to one end of the front wire stretcher, a storage bin and means for joining the lower ends of the side members to each other and for holding the storage bin to the structure. Further, rectangular mesh defining means are provided carried by the rack's structure for defining a plurality of openings dimensioned to support a wide variety of conventional hand tools and other such articles.

DETAILED DESCRIPTION OF THE PREFERRED EMBODIMENT

Figure 1:
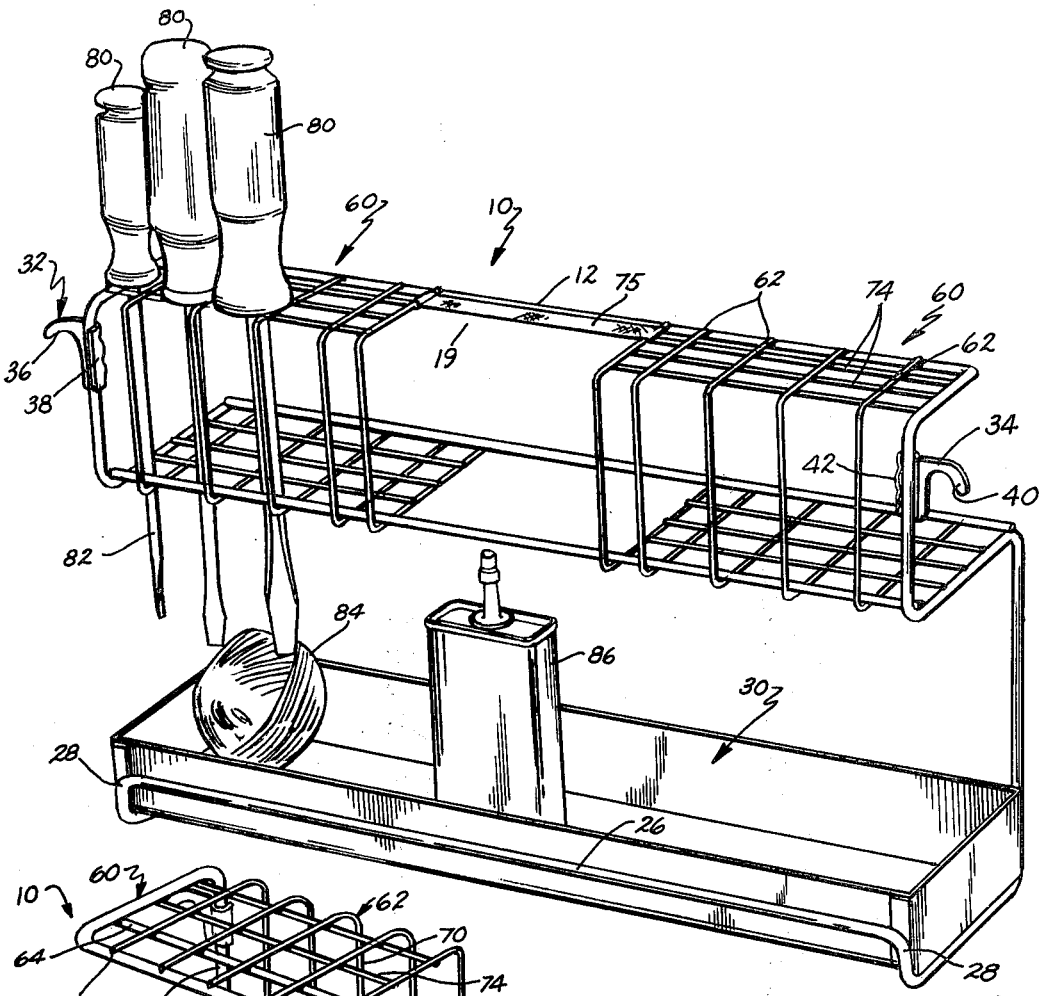
FIG. 1 is a rear, perspective view of the unique rack structure for the storage of hand tools and the like in accordance with the present invention.
Figure 2:
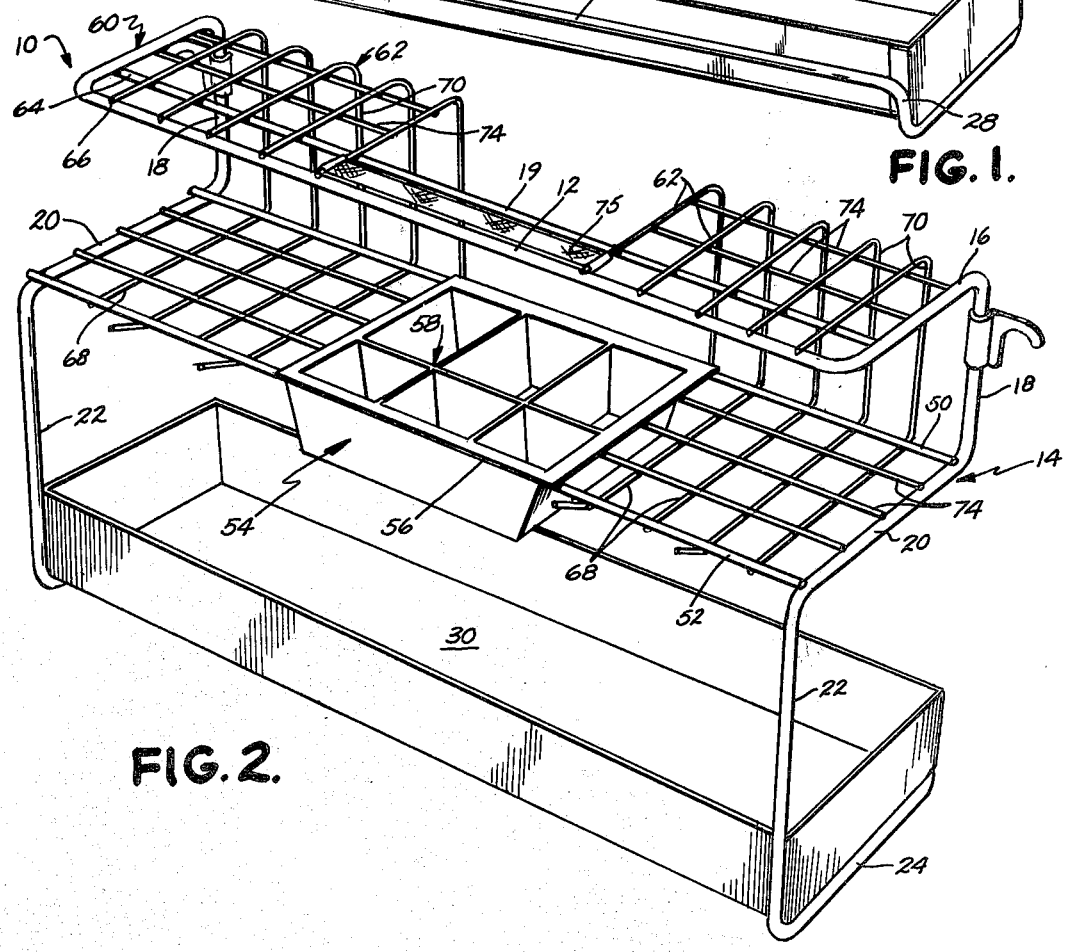
FIG. 2 is a front, perspective view of the rack structure of FIG. 1 further including a compartmentalized, small parts bin.
Figure 3:
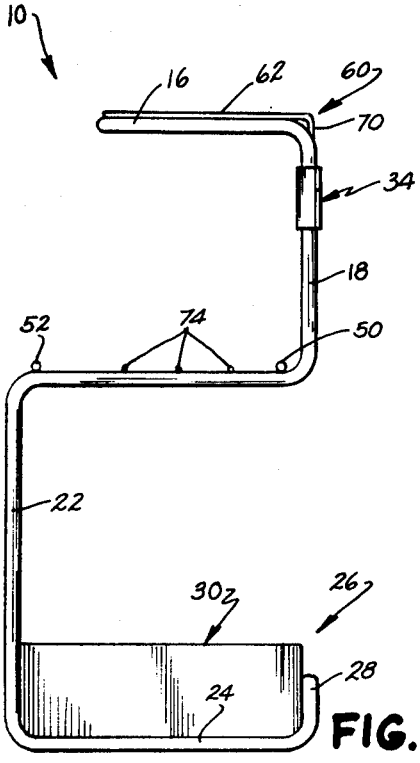
FIG. 3 is a side, elevational view of the rack structure of FIG. 1.

The preferred embodiment of the unique tool caddy or wire rack structure in accordance with the present invention is illustrated in FIGS. 1–3 and generally designated 10. In the preferred embodiment, the main portion of the caddy 10 is fabricated from a single length of wire. The wire is bent to define an elongated, horizontal front wire stretcher 12 and side members 14 joined to the ends of the front stretcher 12. The side members 14 extend downwardly in a generally vertical plane. The front stretcher 12 interconnects the side members.

In the preferred form, each of the side members has a generally S-shape and includes a first horizontal portion 16 integral with an end of the front stretcher 12. Formed integral with and depending from the first horizontal portion 16 of the side member is a first vertical portion 18. A top stretcher 19 may join the portions 18 together. The top stretcher extends in a parallel relationship with the front stretcher 12. Extending outwardly from the first vertical portion 18 is a second horizontal portion 20. Extending downwardly from the second horizontal portion 20 at the front end of the rack structure is a second vertical portion 22. Extending rearwardly from the second vertical portion 22 of the side member is a third horizontal portion 24. The third horizontal portions 24 of the side members define a base for the rack permitting the rack to be supported on a horizontal surface. The portions 16, 18, 20, 22 and 24 of the side members all lay in the same vertical plane.

The free ends of the third horizontal portions 24 of each of the side members are joined by an elongated, generally U-shaped rear wire member 26. The legs 28 of the wire member 26 are integral with the ends of the third horizontal portions 24 of each side member. This rear wire member 26 functions in part to support and hold an open, rectangular bin 30. As seen in FIGS. 1, 2 and 3, the bin 30 and the side members 14 are dimensioned so that the bin rests on the third horizontal portions 24 of the side members and is captured or held by the rear wire member 26. Preferably the bin snap fits between portions 22 of the side members and wire members 26. The wire member 26 joins the side members and forms a pocket for holding the storage bin.

The first vertical portions 18 of the side members 14 serve as vertical surface engaging portions of the structure. These members 18 may have support means 32, 34 attached or secured thereto. The support means 32 is an outer hanger and includes an inverted hook portion 36 and an integral right angle tab 38. The support means 34 is an inner hanger and includes an inverted hook portion 40 and a semi-cylindrically shaped tab 42. The inner and outer hangers 32, 34 are employed to suspend the rack from spaced anchors (not shown) secured to the wall or other vertical surface. This mounting arrangement is of the type disclosed in Applicant's commonly owned application, Ser. No. 636,636, filed Dec. 1, 1975, entitled DETACHABLE RACK ANCHOR, and now U. S. Pat. No. 4,004,526. Other means could be employed for supporting the unique tool caddy rack structure in accordance with the present invention from a vertical wall surface.

Extending between the knees of the side members defined by the junction of the first vertical portions 18 with the second horizontal portions 20 is an elongated, intermediate rear stretcher wire 50. The stretcher wire 50 joins the side members 14 together. Extending between the forward knees of the side members defined by the juncture of the second horizontal portions 20 with the second vertical portions 22 is an intermediate, front stretcher 52. The intermediate rear and front stretchers 50, 52, respectively, support a small parts bin 54. The small parts bin 54 has a generally rectangular shape, an open top and a peripheral, outwardly extending flange 56. The flange 56 is dimensioned so that the parts bin may be placed between the intermediate stretchers 50, 52 and the undersurface of the flange 56 will engage these intermediate stretchers. In this manner, the parts bin 54 is removably supported by the rack structure. As seen in FIG. 2, the parts bin 54 may be compartmentalized by a plurality of walls 58 so that it is readily adapted for the storage of small parts such as screws, nuts, bolts, and the like.

Provision is made for the stable storage of small hand tools in a generally vertical orientation. In the preferred form, this capability is provided by a plurality of rectangular mesh defining means 60 carried by the rack structure. As best seen in FIGS. 1, 2 and 3, the rectangular mesh defining means 60 includes a plurality of generally U-shaped transverse wire strands 62. Each transverse strand 62 includes a first leg 64 joined at its free end 66 to the elongated, horizontal front wire stretcher 12. The second leg 68 of each transverse strand is joined at its free end to the intermediate, front stretcher 56. The base 70 of each strand extends in the same vertical plane as the first vertical portions 18 of the side members 14. The knee defined by the base 70 and the second leg 68 of each transverse strand is joined to the structure at the rear intermediate stretcher 50.

Extending perpendicular to the transverse strands 62 are a plurality of spaced, parallel, longitudinal strands 74. The longitudinal strands 74 are divided into two groups. The first group of strands 74 are joined to the first legs 64 of the transverse strands 62. This group of longitudinal strands is, therefore, positioned generally in the same horizontal plane as the front wire stretcher 12 and the first horizontal portions 16 of the side members 14. The spacing between the parallel transverse strands 62 and the parallel longitudinal strands 74 is selected so that the rectangular mesh 60 defines a plurality of openings for supporting a variety of hand tools, such as the screwdrivers 80 illustrated in FIG. 1, in a vertical orientation. The base of the handle of each of the screwdrivers 80 is larger than the openings defined by the transverse and longitudinal strands and therefore will not pass through the openings.

The second group of longitudinal strands 74 extends between the second legs 68 of the transverse strands 62. Each of the strands 74 of the second group extend in a spaced, parallel relationship with each other and are also joined at one of their ends to the second horizontal portion 20 of the side members. A handle strap 75 is preferably provided between the innermost strands 62 of the spaced mesh defining means. The strap 75 aids in carrying the caddy from point to point. The handle strap 75, therefore, increases the versatility of the device and makes it easily portable.

As best seen in FIG. 1, when screwdrivers or other hand tools, such as pliers, adjustable wrenches and the like, are passed through the openings defined by the first group of longitudinal strands 74 with the transverse strands 62, the elongated portions 82 of the tools will extend into the openings defined by the second group of longitudinal strands 74 and the second legs 68 of the transverse strands 62. This arrangement provides for stability of the tools when they are carried by the tool caddy since the tools are disposed in vertically spaced openings defined by the wire mesh means.

Also, as seen in FIG. 2, the rectangular mesh means 60 are longitudinally spaced from each other so that the innermost transverse strands 62 are engaged by the peripheral flange 56 of the parts bin 54 to thereby support the parts bin along with the intermediate rear and front stretchers 50, 52.

The unique tool caddy rack structure is easily manufactured with the main portion of the frame including the side members, the front stretcher and the rear wire member being preferably fabricated from a single length of wire. The intermediate rear and front stretchers are easily joined to the side members through conventional welding techniques, for example. The rectangular mesh defining means 60 are also easily fabricated from wire and joined to the rack structure by conventional welding techniques. The unique tool caddy provides for the vertical storage of conventional hand tools such as screwdrivers, adjustable wrenches, pliers, hammers and the like in an open, readily organizable fashion. The open topped storage bin 30 provides for the ready storage of miscellaneous small articles 84, 86, as seen in FIG. 1. Also, the compartmentalized small parts bin 54 stores washers, cotter pins, nuts, bolts and the like in an easily organized, readily accessible and open fashion. The tool caddy may be suspended from a vertical surface in the workshop through the support means 32, 34 or it may be placed on a horizontal surface such as a workbench or an existing shelf since the third horizontal portions 24 of the side members can also serve as a base or leg structure.

The tool caddy in accordance with the present invention, therefore, substantially eliminates the problems and frustrations heretofore experienced in the storage and organization of hand tools, small parts and miscellaneous articles in a workshop environment. The device is aesthetically pleasing, portable, easily and relatively inexpensively manufactured and versatile.

ALTERNATIVE EMBODIMENT

Figure 4:
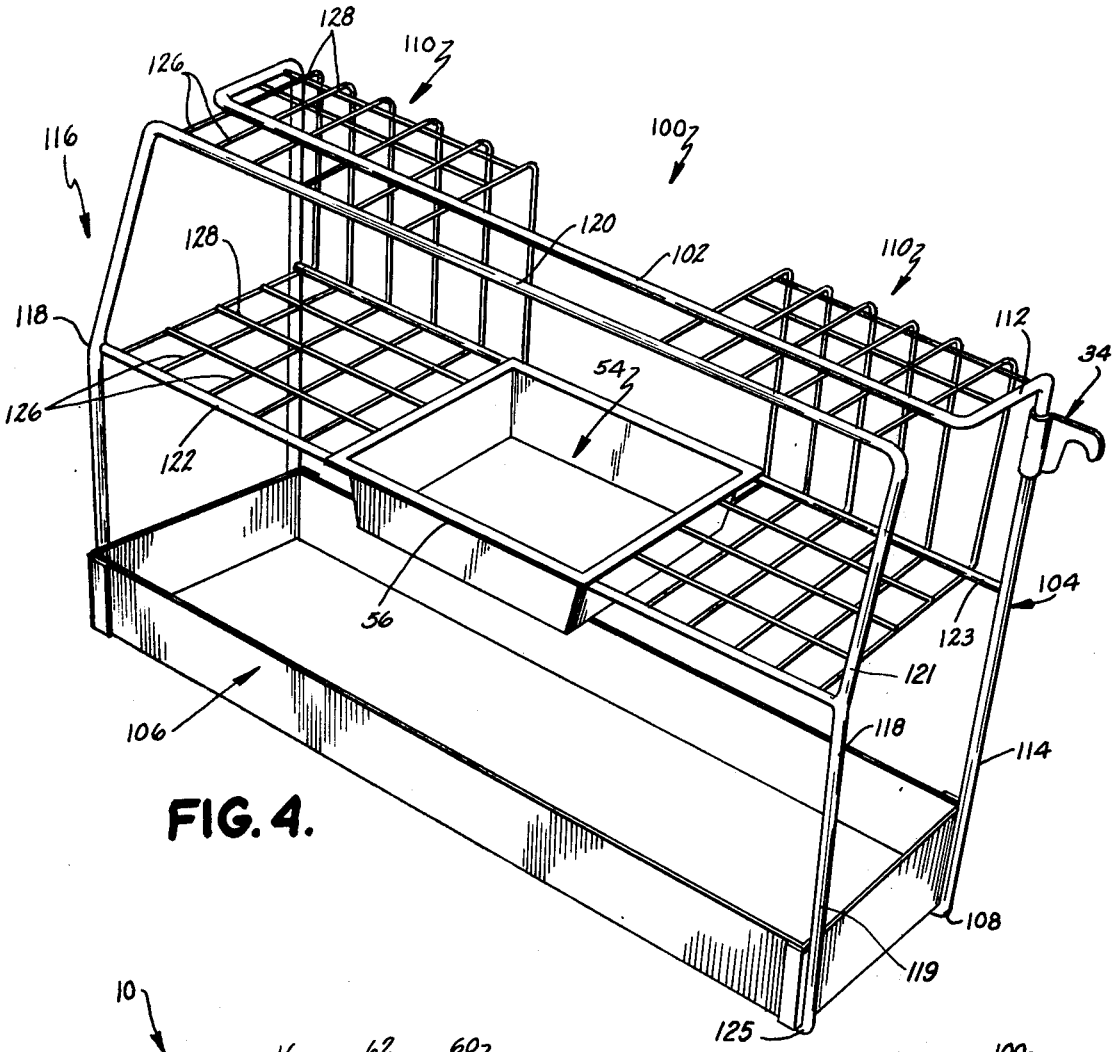
FIG. 4 is a front, perspective view of an alternative embodiment of the rack structure in accordance with the present invention.
Figure 5:
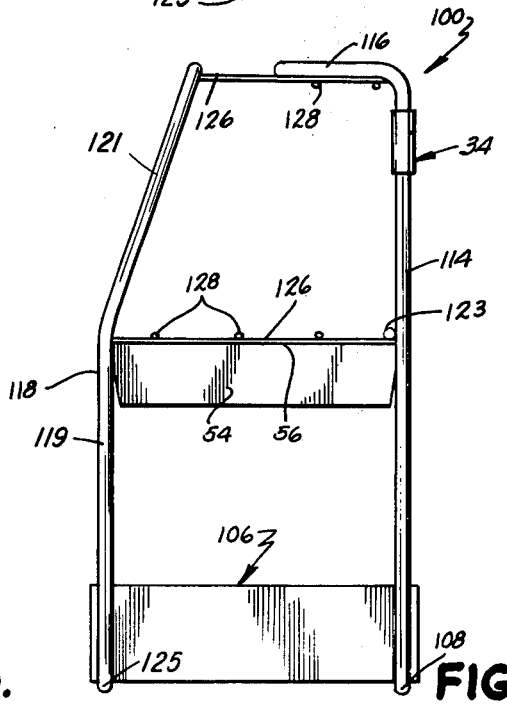
FIG. 5 is a side, elevational view of the rack structure of FIG. 4.

An alternative embodiment of the unique tool caddy in accordance with the present invention is illustrated in FIGS. 4 and 5 and generally designated 100. The alternative embodiment 100 similarly includes an elongated, horizontal front wire stretcher 102, a pair of wire side members 104 each joined to one end of the front wire stretcher and extending downwardly therefrom. Also, the alternative rack structure 100 supports a storage bin 106 through a wire member 108 which joins the lower ends of the side members 104. Wire mesh defining means 110 are joined to the rack structure for the open storage of conventional hand tools. With the alternative embodiment 100, however, the side members 104 are generally L-shaped and include a first leg 112 and a second leg 114. The lower ends of the second legs 114 are joined by the rear wire member 108. A generally rectangular shaped wire member 116 is positioned in front of the horizontal front stretcher 102 and the side members 104. The generally rectangular shaped wire member 106 includes side wires 118, a top wire 120, and a bottom wire 125. The side wires 118 as seen in FIG. 5 include a vertical portion 119 and an angled portion 121.

Extending between the second vertical legs 114 of the side members 104 is an intermediate, rear stretcher 123. Extending between the side members 118 of the rectangular wire member 116 at the juncture of portions 119 and 121 is an intermediate, front stretcher 122. The rear intermediate stretcher 123 and the front intermediate stretcher 122 are disposed in the same horizontal plane. As with the preferred embodiment, these intermediate stretchers support a parts bin 54 which includes a peripheral flange 56 resting on the intermediate front and rear stretchers 122, 123. The storage bin 106 in the alternative embodiment rests on the wires 108 and 122 and is also held in place by the second leg 114 of the side member and by the side portions 118 of the rectangular wire member. The side wires 118, portions 114 and portions 108, 122 define a pocket to hold the bin in a snap fit fashion.

The generally U-shaped transverse strands 126 of the wire mesh defining means 110 are joined to the top portion 120 of the rectangular wire member 116 and to the rear intermediate stretcher 123 and the front intermediate stretcher 122. The longitudinal strands 128 of each wire mesh defining means 110 are similarly divided into first and second groups with the first group positioned in the same horizontal plane as the front stretcher 102 and the first legs 112 of the side members. The second group is positioned in the same horizontal plane as the rear and front intermediate stretchers 123, 122, respectively.

The alternative embodiment illustrated in FIGS. 4 and 5 is also easily manufactured, aesthetically pleasing and provides for the open, stable, readily organizable storage of conventional hand tools, small parts and other miscellaneous articles. As with the previous embodiment, hanger means 32, 34 may be secured to the side members 104 to permit suspension of the tool caddy 100 from a vertical wall surface. The side members 104, the wire joining means or rear wire member 108 and the rectangular wire member 116 also provide a stable base permitting placement of the alternative caddy on a horizontal work surface or existing shelf structure.

In view of the foregoing description, it should now be readily apparent that the unique tool caddy in accordance with the present invention provides substantial advantages over conventional storage proposals. Various modifications to the disclosed tool caddy will undoubtedly now become apparent to those of ordinary skill in the art which would not depart from the inventive concepts disclosed herein. It is expressly intended, therefore, that the above description should be considered as that of the preferred and alternative embodiments only. The true spirit and scope of the present invention will be determined by reference to the appended claims.

The embodiments of the invention in which an exclusive property or privilege is claimed are defined as follows:

1. A rack structure for the storage of hand tools and miscellaneous articles, comprising:

an elongated, horizontal front wire stretcher;

a pair of wire side members, each joined to one end of said front wire stretcher and extending downwardly therefrom;

a storage bin;

wire means for joining the lower ends of said side members to each other and forming a pocket for holding said storage bin in a snap fit fashion, said storage bin resting on said wire side members and said wire side members defining a base to support the rack structure on a horizontal surface;

rectangular mesh defining means joined to said front wire stretcher and said side members for defining a plurality of openings dimensioned to support a variety of hand tools; and a parts bin and means joined to said side members for supporting said parts bin above said storage bin, each of said side members comprising:

a generally S-shaped piece having a first horizontal portion joined to said front stretcher.

2. A rack structure as defined by claim 1 wherein said wire joining means comprises a generally U-shaped wire piece having an elongated base and depending legs, said legs joined to said side members and defining therewith said pocket, said S-shaped side members and said U-shaped wire piece dimensioned to snap fit around said storage bin.

3. A rack structure as defined by claim 2 wherein said parts bin supporting means comprises:

an intermediate front stretcher extending between said side members and an intermediate rear stretcher extending between said side members in spaced, parallel relationship to said intermediate front stretcher.

4. A storage rack as defined by claim 3 wherein said S-shaped side members each include a first vertical portion joined to said first horizontal portion, a second horizontal portion joined to said first vertical portion, a second vertical portion joined to said second horizontal portion and extending downwardly therefrom and a third horizontal portion joined to said second vertical portion, said third horizontal portion being joined to said U-shaped wire piece and defining a base for the rack.

5. A storage rack as defined by claim 4 wherein said rectangular mesh defining means includes a plurality of U-shaped transverse strands each having a first leg joined at one end to said elongated, horizontal front wire stretcher and a second leg joined to said intermediate front stretcher.

6. A rack structure for the storage of hand tools and miscellaneous articles, comprising:

an elongated, horizontal front wire stretcher;

a pair of wire side members, each joined to one end of said front wire stretcher and extending downwardly therefrom;

a storage bin;

wire means for joining the lower ends of said side members to each other and forming a pocket for holding said storage bin in a snap fit fashion;

rectangular mesh defining means joined to said front wire stretcher and said side members for defining a plurality of openings dimensioned to support a variety of hand tools; and a parts bin and means joined to said side members for supporting said parts bin above said storage bin, each of said side members comprising a generally S-shaped piece having a first horizontal portion joined to said front stretcher, said wire joining means comprising a generally U-shaped wire piece having an elongated base and depending legs, said legs joined to said side members, said parts bin supporting means comprising an intermediate front stretcher extending between said side members and an intermediate rear stretcher extending between said side members in spaced, parallel relationship to said intermediate front stretcher, said S-shaped side members each including a first vertical portion joined to said first horizontal portion, a second horizontal portion joined to said first vertical portion, a second vertical portion joined to said second horizontal portion and extending downwardly therefrom and a third horizontal portion joined to said second vertical portion, said rectangular mesh defining means including a plurality of U-shaped transverse strands each having a first leg joined at one end to said elongated, horizontal front wire stretcher and a second leg joined to said intermediate front stretcher, and said rectangular mesh defining means further including a plurality of longitudinal strands, said longitudinal strands being divided into two groups, the first group extending between the first legs of said transverse strands joined to said elongated horizontal front wire stretcher and the second group extending between the second legs of said transverse strands joined to said intermediate front stretcher.

7. A rack structure for the storage of hand tools and miscellaneous articles, comprising:

an elongated, horizontal front wire stretcher;

a pair of wire side members, each joined to one end of said front wire stretcher and extending downwardly therefrom;

a storage bin;

wire means for joining the lower ends of said side members to each other and forming a pocket for holding said storage bin in a snap fit fashion, said storage bin resting against said wire side members and on said wire means and said wire means defining a base to support the rack structure on a horizontal surface;

rectangular mesh defining means joined to said front wire stretcher and said side members for defining a plurality of openings dimensioned to support a variety of hand tools, each of said side members including generally L-shaped portions having a first horizontal leg joined at its free end to said horizontal front stretcher and a second generally vertical leg extending downwardly from said first leg; and a parts bin and support means joined to said side members for supporting said parts bin above said storage bin; and a generally rectangular shaped wire member having spaced, side wires positioned in front of said horizontal front stretcher and said side members, said generally rectangular shaped wire member being joined to said rectangular mesh defining means; said wire joining means including an elongated wire piece joining the free ends of said second legs of said side members, said storage bin being held and supported by said rectangular shaped wire member and said elongated wire piece.

8. A storage rack as defined by claim 7 wherein said parts bin supporting means comprises an intermediate front stretcher extending between the side wires of said rectangular shaped wire member and in vertically spaced parallel relationship to said front horizontal stretcher and an intermediate rear stretcher extending between said side members in the same horizontal plane as said intermediate front stretcher.

9. A storage rack as defined by claim 8 wherein said rectangular mesh defining means includes a plurality of U-shaped transverse strands each joined at one end to said elongated, horizontal front wire stretcher and at the other end to said intermediate front stretcher.

10. A rack structure for the storage of hand tools and miscellaneous articles, comprising:

an elongated, horizontal front wire stretcher;

a pair of wire side members, each joined to one end of said front wire stretcher and extending downwardly therefrom;

a storage bin;

wire means for joining the lower ends of said side members to each other and forming a pocket for holding said storage bin in a snap fit fashion;

rectangular mesh defining means joined to said front wire stretcher and said side members for defining a plurality of openings dimensioned to support a variety of hand tools;

a parts bin and means joined to said side members for supporting said parts bin above said storage bin, each of said side members including generally L-shaped portions having a first horizontal leg joined at its free end to said horizontal front stretcher and a second generally vertical leg extending downwardly from said first leg, and a generally rectangular shaped wire member having spaced side wires positioned in front of said horizontal front stretcher and said side members, said wire joining means including an elongated wire piece joining the free ends of said second legs of said side members, said storage bin being held and supported by said rectangular shaped wire member and said elongated wire piece, said parts bin supporting means comprising an intermediate front stretcher extending between the side wires of said rectangular shaped wire member and in spaced parallel relationship to said front horizontal stretcher and an intermediate rear stretcher extending between said side members in the same horizontal plane as said intermediate front stretcher, said rectangular mesh defining means including a plurality of U-shaped transverse strands each joined at one end to said elongated, horizontal front wire stretcher and at the other end to said intermediate front stretcher, said rectangular mesh defining means further including a plurality of longitudinal strands, said longitudinal strands being divided into two groups, the first group extending between said transverse strands in the same horizontal plane as said horizontal front wire stretcher, the second group extending between said transverse strands intermediate said intermediate front stretcher and said intermediate rear stretcher.

11. A wire rack for the storage of hand tools and miscellaneous small articles, said rack being suspendable from a vertical surface or placeable on a horizontal surface and comprising:

a pair of spaced, parallel side members, said side members defining vertical surface engaging portions;

wire means extending between said side members for interconnecting said side members;

rectangular mesh defining means joined to said interconnecting wire means and said side members for defining vertically spaced openings dimensioned to support a variety of hand tools in a generally vertical orientation;

means on said side members for supporting said side members from a vertical surface; and base defining means joined to said side members for supporting said rack on a horizontal surface, said side members including a first horizontal portion and a first vertical portion, said first vertical portion being said vertical surface engaging portion and being joined to said first horizontal portion at one end thereof and wherein said wire means includes an elongated, horizontal front wire stretcher extending between said first horizontal portion of each of said side members in spaced relationship with said first vertical portion, said side members further including a second horizontal portion extending from said first vertical portion, a second vertical portion extending downwardly from said second horizontal portion and wherein said base defining means includes a third horizontal portion extending from said second vertical portion, said portions of said side member all lying in the same vertical plane.

12. A wire rack for the storage of hand tools and miscellaneous small articles, comprising:

a pair of spaced, parallel side members;

wire means extending between said side members for interconnecting said side members;

rectangular mesh defining means joined to said interconnecting wire means and said side members for defining vertically spaced openings dimensioned to support a variety of hand tools in a generally vertical orientation;

means on said side members for supporting said side members from a vertical surface; and base defining means joined to said side members for supporting said rack on a horizontal surface, said side members including a first horizontal portion and a first vertical portion, said wire means including an elongated, horizontal front wire stretcher extending between said front horizontal portions of each of said side members, said side members further including a second horizontal portion extending from said first vertical portion, a second vertical portion extending downwardly from said second horizontal portion and said base defining means including a third horizontal portion extending from said second vertical portion, said portions of said side member all lying in the same vertical plane, and said mesh defining means comprising:

a plurality of longitudinally spaced, U-shaped transverse wire strands, each having a first leg joined to said front wire stretcher, a base extending vertically and parallel to said side members and a second leg extending from said base in spaced, parallel relationship to said first leg; and a plurality of longitudinal strands extending in transversely spaced, parallel relationship between the first legs of said transverse strands and said second legs of said transverse strands.

13. A wire rack as defined by claim 12 further including:

an intermediate front stretcher extending between said side members and joined to the ends of said second legs of said transverse strands; and an intermediate rear stretcher extending between said side members, spaced from said intermediate front stretcher and lying in the same horizontal plane as said intermediate front stretcher.

14. A wire rack as defined by claim 13 further including a small parts bin having an open top and a peripheral flange, the undersurface of said peripheral flange resting on said intermediate front and rear stretchers.

15. A wire rack as defined by claim 14 further including a storage bin extending between and resting on said third horizontal portions.

* * * * *